US005905429A

United States Patent [19]

Hornstein et al.

[11] Patent Number: 5,905,429

[45] Date of Patent: May 18, 1999

[54] AUDIO LABEL

[75] Inventors: Robert C. Hornstein, Las Vegas, Nev.; Joseph R. Mackenroth, III, New Orleans, La.

[73] Assignee: City of Lights, Inc., Las Vegas, Nev.

[21] Appl. No.: 08/845,675

[22] Filed: Apr. 25, 1997

[51] Int. Cl.[6] ..... G08B 7/00

[52] U.S. Cl. ..... 340/384.6; 340/568; 340/547; 340/583; 704/272

[58] Field of Search ..... 340/692, 384.6, 340/568, 547, 583; 704/272, 274

[56] References Cited

U.S. PATENT DOCUMENTS

| | | | |
|---|---|---|---|
| 3,462,157 | 8/1969 | Barnett et al. | 274/9 |
| 4,035,941 | 7/1977 | Deffner | 40/219 |
| 4,222,188 | 9/1980 | Tarrant et al. | 40/152.1 |
| 4,227,327 | 10/1980 | Thompson | 40/473 |
| 4,381,558 | 4/1983 | Bearden | 369/68 |
| 4,470,213 | 9/1984 | Thompson | 40/473 |
| 4,567,359 | 1/1986 | Lockwood | 235/381 |
| 4,611,262 | 9/1986 | Galloway et al. | 361/421 |
| 4,670,798 | 6/1987 | Campbell et al. | 360/12 |
| 4,703,573 | 11/1987 | Montgomery et al. | 40/455 |
| 4,791,741 | 12/1988 | Kondo | 40/124.1 |
| 4,882,724 | 11/1989 | Vela et al. | 364/401 |
| 4,912,457 | 3/1990 | Ladd | 340/573 |
| 4,934,079 | 6/1990 | Hoshi | 40/427 |
| 5,003,859 | 4/1991 | Monte et al. | 84/423 |
| 5,032,716 | 7/1991 | Lam et al. | 704/272 |
| 5,063,698 | 11/1991 | Johnson et al. | 40/124.1 |
| 5,209,665 | 5/1993 | Billings et al. | 434/169 |
| 5,245,171 | 9/1993 | Fox et al. | 235/492 |
| 5,264,822 | 11/1993 | Vogelman et al. | 340/692 |
| 5,275,285 | 1/1994 | Clegg | 206/449 |
| 5,510,665 | 4/1996 | Conley | 310/303 |

*Primary Examiner*—David R. Hudspeth
*Assistant Examiner*—Daniel Abebe
*Attorney, Agent, or Firm*—Richard R. Mybeck; Peter B. Scull

[57] ABSTRACT

An audio label comprising a circuit board substrate with a sound-generating microchip and a photovoltaic cell both attached to the substrate such that the microchip is electrically connected to the photovoltaic cell so that power is provided to the sound-generating microchip. A sound reproduction unit is also attached to the substrate and is connected to the sound-generating microchip communicates signals to the sound reproduction unit which are then converted by the sound reproduction unit to audible sounds. A system for audio label operation is also disclosed. The system includes a separate transmitter which transmits electromagnetic waves, such as light, infrared or radio waves to one or more audio labels which have electromagnetic wave receiving circuit elements, such as phototransistors disposed thereon. The transmitter thus sends wave signals to each label each of which then converts the wave signals to electric signals which each sound reproduction unit then converts to audible sounds.

8 Claims, 5 Drawing Sheets

FIG. 1
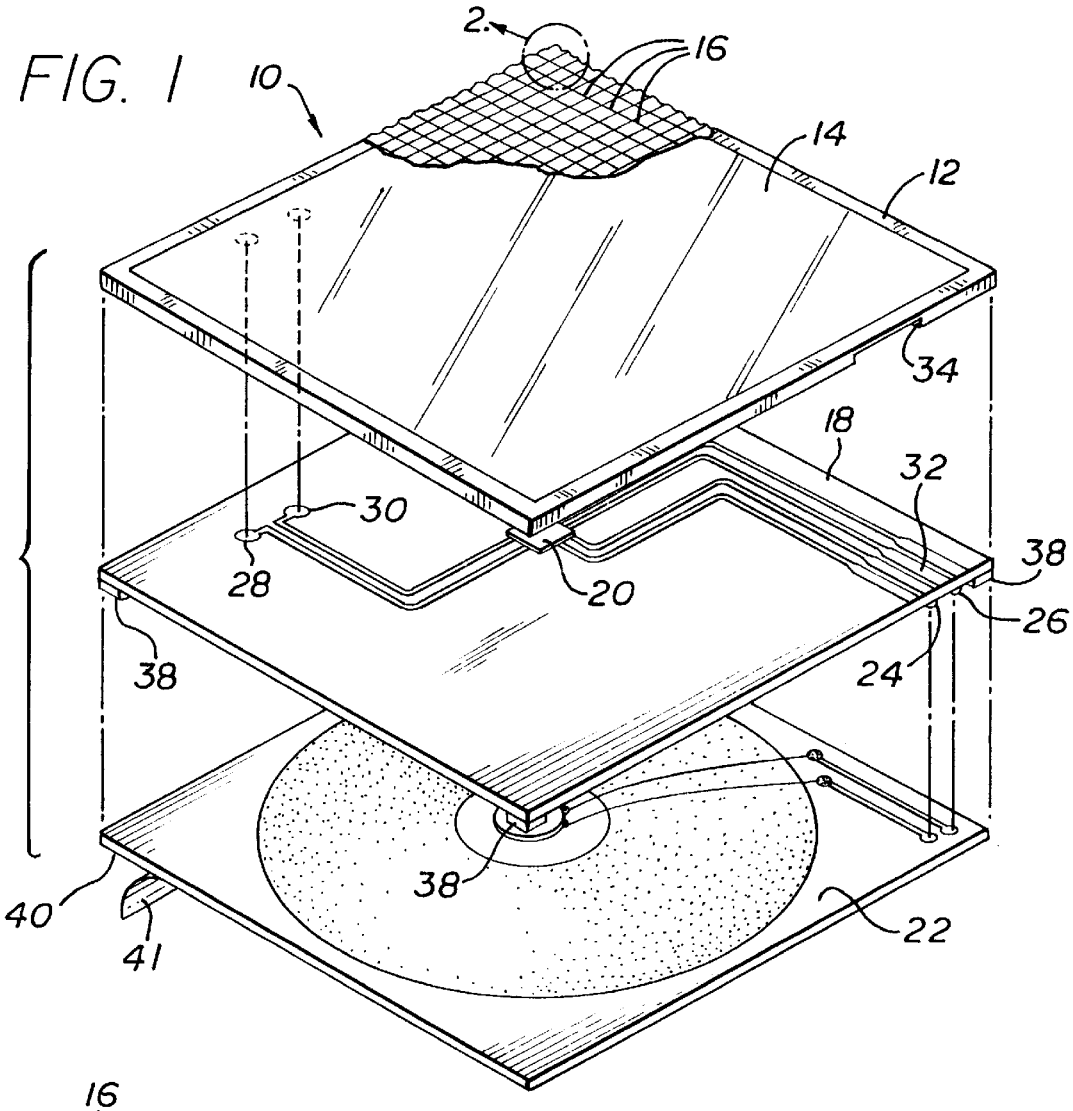
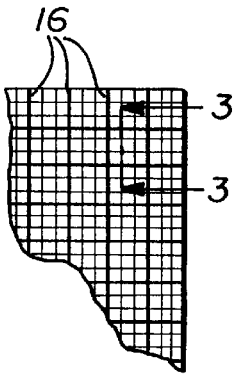
FIG. 2
FIG. 3
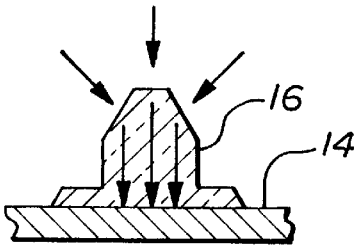
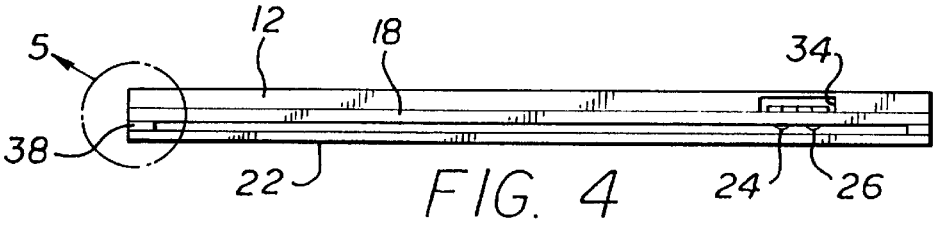
FIG. 4

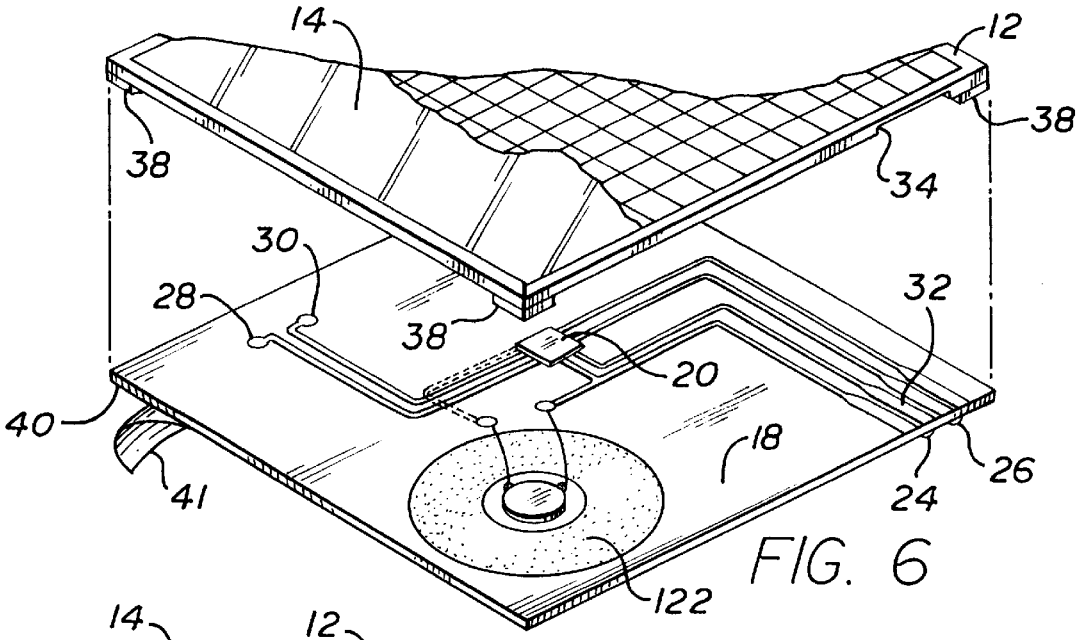
FIG. 6
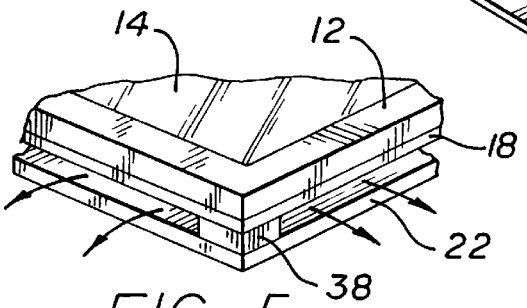
FIG. 5
FIG. 8
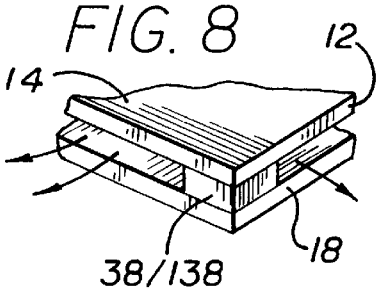
FIG. 7
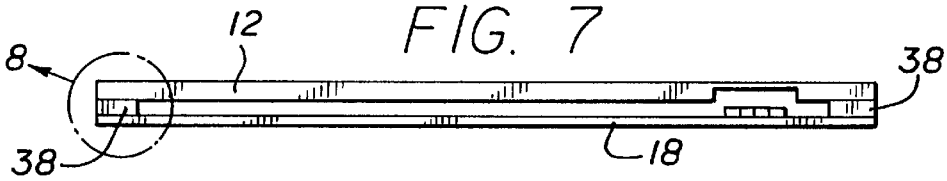
FIG. 14
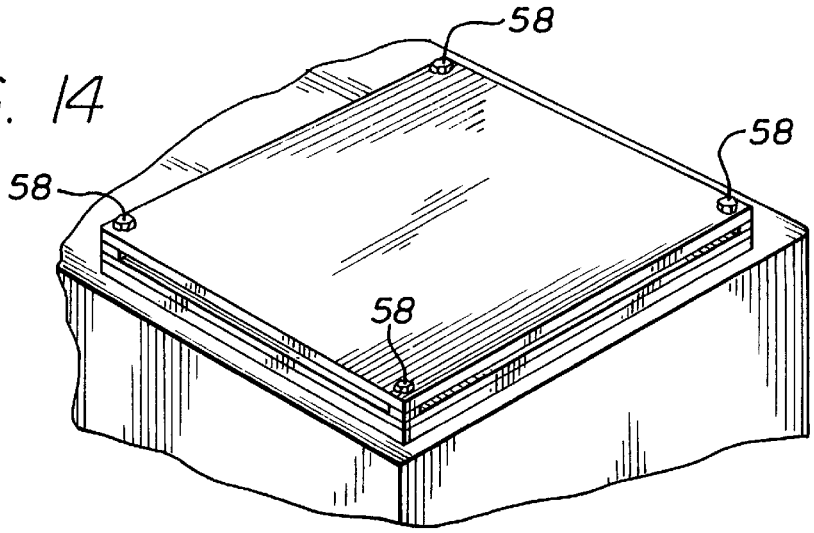

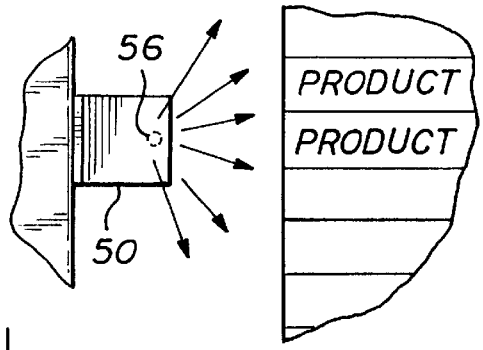
FIG. 13
FIG. 12
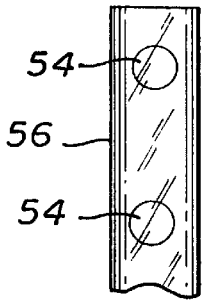
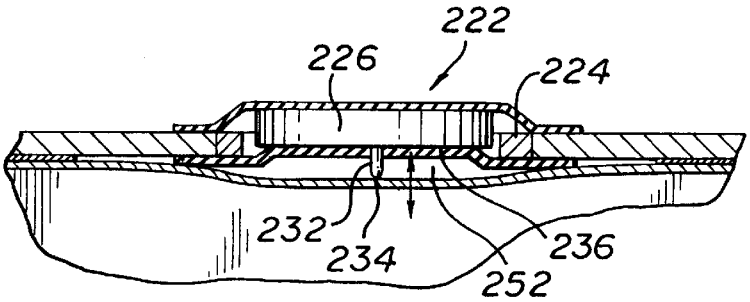
FIG. 10
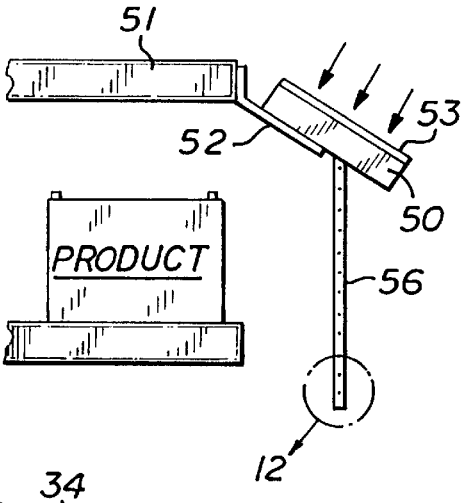
FIG. 11
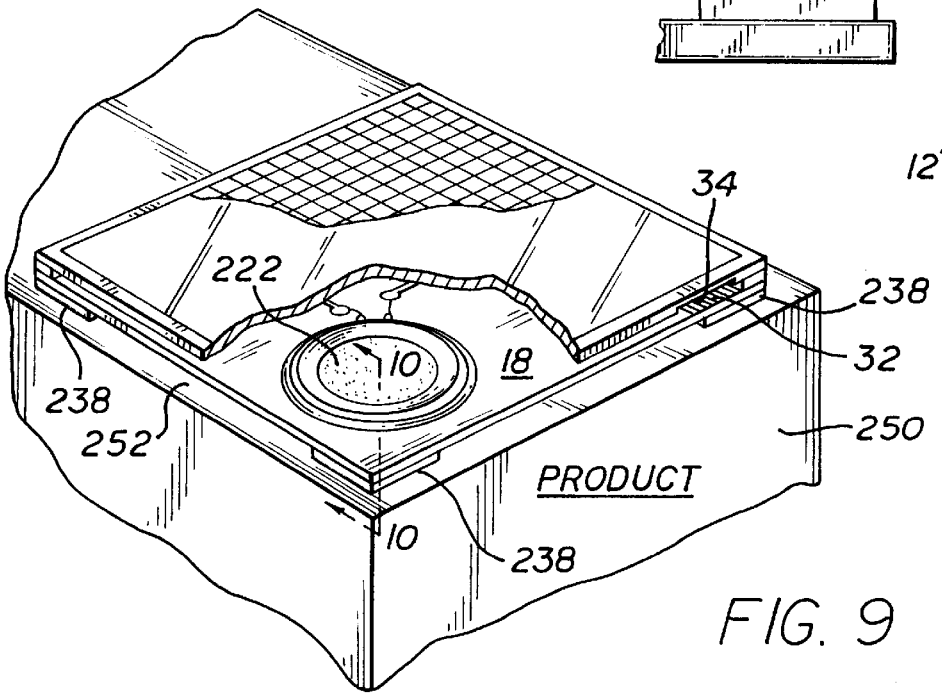
FIG. 9

AUDIO LABEL

INTRODUCTION

The present invention relates generally to an audio label device and more particularly to a selectively mountable strip device having a solar or photovoltaically powered sound chip and speaker or voice coil disposed therein. The label is strategically attachable to a product or product packaging in any location throughout a store, trade show, showroom, etc., and is programmed to emit a prerecorded sound or message at timed intervals or when the presence of a human is detected within hearing range.

BACKGROUND OF THE INVENTION

Pre-programmed or programmable talking "things" have been the object of a number of patents. For example, Barnett et al. (U.S. Pat. No. 3,462,157) teaches an audible greeting card comprising a pair of panel members, the first panel carrying a sound track, and the second one having a sound pick-up member and an amplifier speaker which is actuated by the sound pick-up member.

Other prior patents include Deffner (U.S. Pat. No. 4,035,941) who teaches an audio-visual display device which sequentially displays and describes merchandise. A timer is used to control the operation of a plurality of electrical audio and visual display components.

Tarrant et al. (U.S. Pat. No. 4,222,188) teaches a sound reproducing device for either music or speech combined with a display for an opaque sheet on which an insignia is defined that may be a work of art, photograph, printed material or the like. The display is a part of a resonator box that not only amplifies the volume of the sound reproducing device, but provides a number of spaced recesses in the upper portion thereof in which merchandise such as cosmetics or the like may be displayed.

Bearden (U.S. Pat. No. 4,381,558) teaches another talking greeting card, this one having a front display panel and two rear panels adapted to hold the front panel bowed in convex shape by tabs which secure the rear panels together. A flexible sound recording strip extends through a slot in the bowed front panel and has a surface prepared to produce sounds when a sliding element, such as the thumbnail of a user, moves along the surface. The sound is amplified by the bowed front wall and overlapping rear walls.

Calloway et al. (U.S. Pat. No. 4,611,262) teaches an electrical circuit package for greeting cards which provides an electrical circuit via a stamped and formed lead frame supported and insulated in a dielectric housing. When activated, the electrical circuit causes a piezoelectric transducer to generate audio signals in the form of a musical tone, spoken words or both.

Montgomery et al. (U.S. Pat. No. 4,703,573) teaches a visual and audible activated work comprising at least two pivotably turnable pages. A visual image display is affixed to at least one of the pages, the visual image display having first and second visual activation states; the first one of which corresponding to no visual image and the second visual activation state providing a visual image on the visual display. A sound generator is also attached to the work. Electrical control means are connected to the visual display for selectively activating the visual display from one of the visual activation states to another upon pivoting the pages from the open position to the closed position, and the same or similar control means are connected to the sound generator for selectively activating the sound generator to create sound upon pivoting the pages from the closed position to the opened position. Photovoltaic or solar cells are taught for providing power to the audio and/or visual portions of this work.

Kondo (U.S. Pat. No. 4,791,741) teaches card or postal media which can record and playback messages or music, such media being particularly useful to allow the mailer to record his/her own messages or desired music, so that the recipient can easily play them back. The card comprises electrical means (RAM, including one or more microchips) for storing audio information picked up by a microphone; means for generating sound including a speaker; means for producing a mode selection signal corresponding to either a record mode or a playback mode; electrical control means including a TOSHIBA TC 8830 microchip for selectively setting either of the record or playback modes according to the mode selection signal from the signal producing means, converting audio from the microphone from analog to digital and storing it in the storage means when the record mode is selected, retrieving stored information from the storage means converting it from digital to analog, and outputting the analog signal to the generating means when the playback mode is selected; and a card board on which each of the above are mounted.

Hoshi (U.S. Pat. No. 4,934,079) teaches a display device including a display panel having a recorder/playback combination and a sensor which is sensitive to light, sound, heat and/or other stimuli. Objects which are transparent to or shield light and/or which generate sound or heat will, when approaching the panel, automatically actuate the sensor to automatically actuate the recorder/playback combination, thereby producing music or sound from the display panel. The recorder/playback combination can be made thin, small and inexpensive by the use of an IC memory. An on-off switch may be substituted for the sensor. If the sensors are made integral with the recorder/playback combination, then it is possible to obtain increased efficiency and make handling much easier. The use of an IC memory chip for the sound generating source permits free selection of sounds or music. The sounds or music are recordable on the IC chip by an external ROM writer. Playback is obtained automatically by the actuation of the on-off switch or by the sensor which is sensitive to sound, light, heat and the like to produce a sound message.

Johnson et al. (U.S. Pat. No. 5,063,698) teaches a personalized greeting card including an independent, detachable, electronic IC memory device that stores electronic signals, a mechanism for retrieving the electronic signals from the IC memory device, a voice synthesizer which obtains these electronic signals and produces audible sounds representative of the personalized message represented by the electronic signals, and a switch that controls the retrieving device and the voice synthesizer. The IC memory device is separately preprogrammed by an EPROM translator machine which converts a personalized message to electronic signals which are stored in the IC memory device. The memory device is then detached from the EPROM and mounted in the circuitry disposed in the greeting card. Both the IC memory device and the voice synthesizer are coupled to a timer by a control/power line. A battery is used to deliver power to this circuit.

Fox et al. (U.S. Pat. No. 5,245,171) teaches a mailing piece comprising a mailing envelope which has a reusable audible message generator attached thereto. The message generator may be secured (as by adhesive) to the envelope. The message generator provides an audible message which is intended to induce the recipient to retain, read and show the package to others. The envelope has a tab extending therefrom which, when pulled by the recipient, exposes an operating element to activate a talking device which gives a short message. A solar cell or other sensor responsive to light that acts to close (or to power) the electrical circuit of the message generator may be used to activate the message generator when the tab is pulled up to expose that sensor to light.

However, as is readily apparent, none of these prior devices provide tenable stand-alone label devices for use in product presentation which could be disposed in specific store locations or on specific products with product-specific audible messages which would be activated at preset intervals, timed or otherwise, or upon the presence of motion or light changes within a predefined range thereof and which are capable of being powered by conventional store or sun lighting.

BRIEF SUMMARY OF THE INVENTION

The present invention relates generally to a solar or photovoltaically powered audio label for attachment to a product, product packaging, a product display, and/or to any other miscellaneous product exhibition apparatus. More particularly, the present device includes a miniature, photovoltaic power cell, a sound chip and a miniature sound reproduction unit or "speaker" connected thereto such that the entire device can be simply attached by adhesive or like backing to a product, product packaging, a store display, shelving or the like. The chip is powered by store lighting and presents recorded promotional sounds or messages that are reproduced by the speaker. Prior to use, the photovoltaic power cell may be covered with a peel-off protective cover to prevent premature activation of the audio label. The audio label is activated by removing the peel-off cover so that it may generate sounds or "talk" to an approaching customer. The sound track may run continuously, at timed intervals, or it may be activated by a motion sensor.

Accordingly, the primary object of the present invention is to provide a product label which conveys to potential purchasers aural information about the product by "talking" to or using "attention-getting-sounds" to attract a customer.

Another object of the present invention is to provide stand-alone audio labels which may be adhered to the products themselves, to product packaging or to product display shelving or other structures disposed near the products.

A still further object is to provide a photovoltaically powered audio label having a detachable cover disposed over the sensor thereof which can be detached to initiate the talking or sound generating feature and then replaced to silence the sound reproduction.

These and still further objects as shall hereinafter appear are readily fulfilled by the present invention in a remarkably unexpected manner as will be readily discerned from the following detailed description of an exemplary embodiment thereof especially when read in conjunction with the accompanying drawings in which like parts bear like numerals throughout the several views.

BRIEF DESCRIPTION OF THE DRAWINGS

In the drawings:

FIG. 1 is an exploded isometric view of an audio label of the present invention;

FIG. 2 is a partially fragmented plan view of the circled area designated "2" in FIG. 1;

FIG. 3 is a cross-sectional view taken on line 3—3 of FIG. 2;

FIG. 4 is an elevation of an assembled audio label of the present invention;

FIG. 5 is a fragmented isometric view of one corner portion of the label of FIG. 4 as identified by circled area "5" therein;

FIG. 6 is a partially fragmented, exploded isometric view of a second embodiment of the present invention;

FIG. 7 is an elevation of the second embodiment (as shown in FIG. 6) of the present invention;

FIG. 8 is a fragmented isometric view of one corner portion of the audio label shown in FIG. 7 as identified by circled area "8" therein;

FIG. 9 is a partially fragmented isometric view of a third embodiment of the present invention;

FIG. 10 is a cross-sectional view of the audio label of FIG. 9 taken on line 10—10 thereof;

FIG. 11 is an elevation of an audio label and an infrared control system for use in an alternative embodiment of the present invention;

FIG. 12 is an enlarged view of a portion of the control system of FIG. 11 taken from circled area "12" thereof;

FIG. 13 is a plan view of the control system of FIG. 11 in operation relative to multiple product units;

FIG. 14 is an isometric view of a label of the present invention adapted for use with the control system of FIGS. 11–13;

DESCRIPTION OF THE PREFERRED EMBODIMENT

Figure 15:
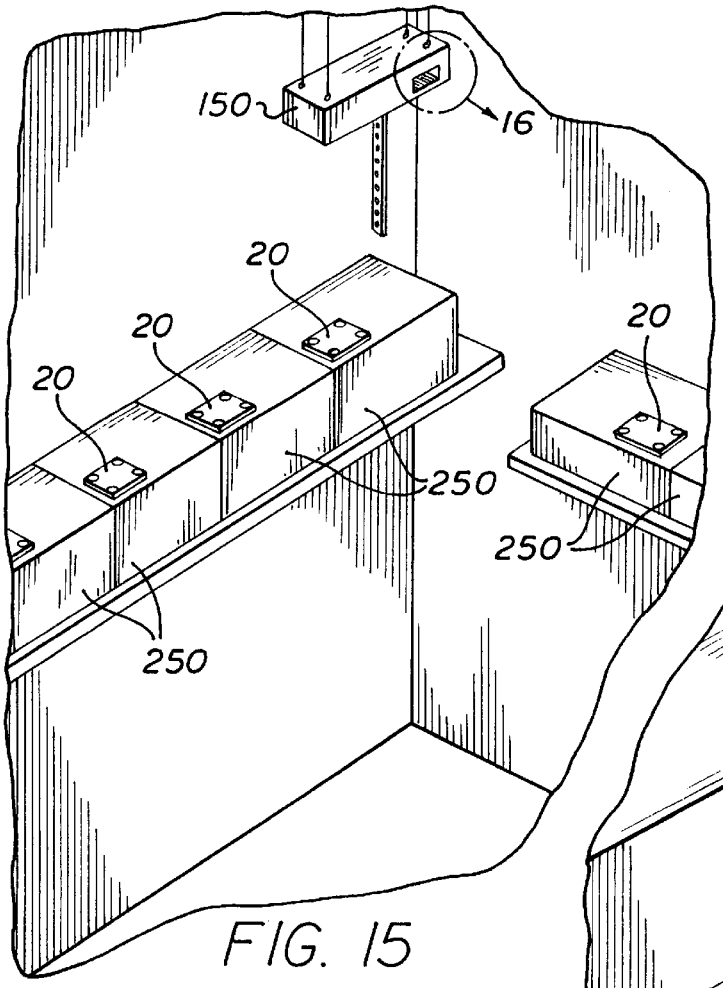
FIG. 15 is an isometric view of a plurality of audio labels in use with an alternative embodiment of a control system.

The present invention comprises an audio label identified in the drawings by the general reference numeral 20. Referring to FIG. 1, a first embodiment of the present invention is shown in which label 20 generally includes a frame 21 on which is mounted a photovoltaic cell array 22. Photovoltaic cell array 22 is composed of one or more photovoltaic (i.e., "solar" or otherwise light-powered) cells, which together comprise an array 22. As shown fragmentarily in FIG. 1 and in more detail in FIGS. 2 and 3, photovoltaic array 22 may have mounted thereover one or more plastic, crystal, or glass pyramids or prisms 23, which assist in gathering and funneling light to array 22. Frame 21 is also attached to a printed circuit board substrate 24. Further attached to substrate 24 are a sound storage and retrieval microchip 25 and a sound reproduction unit 26 which is connected to sound microchip 25 by electrical connectors 27, 28. For simplicity, sound reproduction unit 26 will hereafter be referred to as speaker 26. This, of course, is not in any way intended to nor should it be interpreted as limiting the output of speaker 26 to "spoken" human voice sounds.

In operation, power for sound microchip 25 and speaker 26 is provided by photovoltaic cell array 22. Preferably, microchip 25 has a memory which will not automatically erase simply due to a lack of a continuous power supply. Thus, microchip 25 can continue to retain stored, digitally encoded sounds throughout any interruptions in the supply of power thereto. This is useful when there is a lack of light reaching the photovoltaic cell array 22 such as occurs during shipment, store closure, etc. Power is transferred from cell array 22 to chip 25 by electrical connectors 29, 30.

The sounds for the audio label are, in the preferred embodiment, recorded to chip 25 through an etched-in printed circuit board connector 32, which is accessed through a slot 34 defined in frame 21. The sounds may be programmed via connector 32 from the outside of label 20 by using a conventional microcomputer such as a personal computer (PC), laptop, or handheld computer (none shown). In this way, audio label 20 may then be reprogrammed as many times as one wishes in order to provide a plurality of different messages or sounds to be emitted from an audio label 20. An example of similar computer programmable electronics may be found in the record/playback module, model number ISD-VM110, available from Radio Shack$^{SM}$, a division of Tandy Corporation, Fort Worth, Tex. 76102 (part no. 276-1324). An example of a digital integrated circuit (IC) chip that could also be used with the present invention is the ISD100A IC also available from Radio Shack$^{SM}$ (part no. 276-1325). Several other sound chips are also currently available including others in the ISD® line. The details of the internal structure of an IC chip used with the present invention, whether one of the above or known equivalents thereto will be known to those skilled in the art. Those skilled in the art will thus know or simply ascertain through published manuals how such chips would be used in the present invention; including how they would be connected, programmed and operated.

Furthermore, those skilled in the art will appreciate that other methods for programming and reprogramming sounds (or voices) to chip 25 are available. For example, other digital or analog sources such as compact disc (CD), digital audio tape (DAT) or analog tape players (and/or recorders) as well as MIDI keyboards or like sources may also be used. In these cases, a user would record to these devices (if necessary) as is known and understood in the art with microphones, etc., and, then download to chip 25 through a connector 32 or the like. Of course, a microcomputer may also be used in this process as well. Thus the sounds or voice(s) could alternatively be first downloaded to computer from these alternative sources and then from there fed to chip 25 via connector 32.

Yet another method for recording the sounds or voices to chip 25 includes the direct use of a microphone (not shown). Indeed, microphones are currently available which are small enough to be simply attached to a circuit board such as substrate 24 of the present invention. Examples of such microphones include Panasonic® WM-034 series, inter alia, available through Digi-Key® Catalog No. 966, Digi-Key® Corporation, 701 Brooks Avenue South, Thief River Falls, Minn. 56701-2757; Digi-Key® part nos. P9931-ND et seq. A sample pre-assembled sound record/playback kit using similar microphones is also available from Radio Shack$^{SM}$ (part no. 276-1326).

Microchip 25 may be automatically activated to generate sounds upon the introduction of sufficient light to array 22 such that array 22 provides sufficient power to microchip 25. Thus, when light hits array 22, label 20 "talks" or otherwise produces the desired sounds. If continuous light is present, then, label 20 would "talk" continuously, or a time delay structure may also be included on substrate 24. The time delay structure could take the form of internal circuitry etched directly into chip 25, or as separate timer circuitry such as a separate chip, one or more relays, etc., such as are known in the art. A 555 timer chip with associated circuitry is one example known in the art that could be usable herein. Otherwise, other kinds of triggering mechanisms may be included on each label 20. For example, either a simple mechanical or electrical switch manually operable by the customer could be included. Or, sensors sensitive to motion or the presence of a nearby human body may be disposed on or in a label 20. Such sensors sensitive to, for example, light, sound, temperature or infrared changes immediately around the sensor are available. Those skilled in the art will appreciate viable alternatives for use here. Further specifics regarding the alternative use and disposition of sensors will be discussed below. Exemplary sensors 138 are shown and described relative to FIG. 8 below.

As for speaker 26, in the preferred embodiment as shown in FIG. 1, it may be an electromagnetic microspeaker, such as the Panasonic® 8-ohm microspeakers, EAS-series, Digi-Key® part nos. P9601-ND through P9610-ND. However, other speaker embodiments are available as well; two of which will be described in more detail below (see FIGS. 6–10). One of the alternative embodiments (from FIGS. 6–10) includes a piezoelectric speaker such as part no. 273-091 available from Radio Shack$^{SM}$ (see also part nos. 273-073 and 273-064).

With regard to photovoltaic cell array 22, several types of cells are currently available such as those shown in Edmund Scientific catalogs part nos. G37,336–G37,339. Other cells are available under the Panasonic® name; see for example, part nos. BP-5511C45E and BP-5313C45E, inter alia, as illustrated in the Digi-Key® catalog, No. 966, described above. Again, those skilled in the art will understand the details of the internal structures of the above electrical components (microphones, speakers, photovoltaic cells, etc.), and will thus understand how these or their equivalents are to be connected, programmed and operated. Likewise, those skilled in the art will understand what an appropriate circuit board substrate 24 is, what type to use and how to integrate it with the other elements.

The three main structural portions of label 20 (as shown in FIG. 1); namely, the preferably flexible, molded plastic, metal or metal alloy frame 21 (with photovoltaic cell array 22 attached thereto), the substrate 24, and the speaker 26, are assembled one on top of the other as shown in FIGS. 1, 4 and 5 and are secured in place relative to each other by a suitable adhesive such as cyanoacrylate ester (which is sold under the tradename "Super Glue"). As shown in FIGS. 4 and 5, spacers 38 can be disposed between speaker 26 and printed circuit board substrate 24. Spacers 38 define and provide passageways to allow sound to emanate from speaker 26 without being unduly hindered by substrate 24. This emanation of sound is shown by the arrows in FIG. 5. Additionally, an adhesive surface 40 is disposed on the back side of speaker 26 and is used to attach label 20 to the product to be sold. Protective paper 41 is pre-disposed over adhesive layer 40 during manufacture and is peeled off adhesive layer 40 when label 20 is to be installed for use. A double-sided adhesive such as Scotch™ Brand 9472 or 9690 Laminating Adhesive (from 3M Corp., St. Paul, Minn.) is preferred for use as adhesive 40. As shown, stand-alone label 20 is then readily attachable to a product or may be disposed in any other desired location for use.

Label 20 in this embodiment is intended to be stand-alone meaning that it is a compact, integral unit which is fully operable either alone or as attached to any product, display, or the like. Thus, it is not dependent on any structure of the product to which it may eventually be attached. In this way then, one or more of these devices may be manufactured, marketed, sold and/or distributed separately from the products, displays, etc. to which they correspond and/or may ultimately be attached. As thus defined, stand-alone is not meant to intimate a device which is sturdy enough to be free-standing, a characterization which may or may not be applicable to labels 20 of the current invention.

Referring now to FIG. 6, an alternative embodiment of the present invention is shown. The structure of this second version is similar to that of the first version described above, with the principal exception being the sound reproduction unit. This alternative embodiment makes use of a piezoelectric speaker unit 126. Again, use of the word "speaker" is for the sake of simplicity and not for limitation to "spoken" voice sound reproduction. A primary advantage of using a piezoelectric speaker is its compact, small size. Indeed, presently available piezoelectric speaker elements 126 are thin enough to be mounted directly to a printed circuit board substrate 24 and driven directly by an IC microchip 25. Spacers 38 are also preferably used in this embodiment to allow the sound from speaker 126 to emanate from audio label 20 without physical obstruction. However, as shown in FIGS. 6-8, spacers 38 are, in this embodiment, disposed on the upper surface of substrate 24 whereas in the first embodiment above, as shown in FIGS. 1, 4 and 5, they were disposed on the lower surface of substrate 24. Further, in this embodiment, adhesive 40 is disposed on the rear surface of substrate 24 rather than merely on the rear surface of the speaker. The alternative use of sensors 138 in lieu of spacers 38, as shown in FIG. 8, will be addressed in further detail below.

Referring now to FIGS. 9 and 10, yet another alternative embodiment is shown. The structure of this third version is similar to both of the above embodiments, with the primary exception again, being the speaker unit. This third version has a speaker 222 which is attached to and utilizes a wall of the consumer item or its packaging (either or both of which are cumulatively referred to hereafter as product 250) as the diaphragm for speaker 222. As shown in FIGS. 9 and 10, speaker 222 is attached to circuit board substrate 24 by placing it into a corresponding opening defined in circuit board substrate 24, preferably using rubber cement. Other adhesives or glues as are known in the art may be used as well. Speaker 222 may be electromagnetic or piezoelectric or the like; however, electromagnet componentry is shown and will be further described. Those skilled in the art will appreciate the substitution of one for the other and how to do so. A coil 224 is, in the shown preferred embodiment, circular and is the primary component which attaches to and within the opening defined in circuit board substrate 24 as described above. A thin, disk-type magnet 226 is disposed within the central, circular opening of coil 224 as shown and is held in place by two flexible rubber membranes 228 and 230 which are located one on each of the upper and under sides of both disk magnet 226 and substrate 24. A small protrusion 232 with a rounded nose 234, is attached to the underside 236 of disk magnet 226. The relative terms "upper" and "under" are used only to simplify reference to the drawing and are not intended to limit the invention. In operation, an electrical audio signal is applied to the wires of coil 224, energizing coil 224 to become an electromagnet. This electromagnetism acts upon disk magnet 226, causing it to move and vibrate up and down in response to the audio signal being applied to coil 224. When audio label 20 is properly attached to a product 250 (such as a cardboard box or other firm but moveable surface), nose 234 of protrusion 232 rests against the appropriate surface 252 of product 250, and causes this surface to vibrate, producing amplified sound. An air space is provided (as before) by spacers 238 so that speaker 222 will not be unduly encumbered by air pressure from disk magnet 226 when magnet 226 is moving. Note that in this embodiment the adhesive material (such as layer 40) is used to attach spacers 238 directly to the product as opposed to having adhesive layer 40 attach the speaker or substrate to the product as in the previous embodiments above.

The preferred embodiment of the audio label of the present invention is that of a flexible, photovoltaic or light-powered audio label 20 for use in assisting the selling or marketing of products on a retail level, although label 20 is not limited to use in the retail market exclusively. In use, audio label 20 is small enough (preferably 2"×2") to be adhered to an individual product for sale or inconspicuously to a display surface or a shelf adjacent the product(s) for sale. In any event, label 20 may be properly positioned using a peel-away selfstick adhesive 40. Audio label 20 is then placed in position where it will either talk continuously, at preset timed intervals or in response to sensor activation and will promote the product. Thus, as a potential purchaser passes by, he will hear a specific, pre-recorded sound such as music, attention-grabbing noises or a voice message, which may include information or advertising, describing the product to which the label is attached. Of course, depending on the choice of voice microchip 25, which either may or may not have internal time delay circuitry formed therein, a separate timing circuit may be included within each label 20. Known timer circuitry including known 555 timer chips may be used herein. Simple timing circuits, whether including a timer 555 and/or relay(s) or otherwise, for such use herein are within the skill of the art. A sample 555 timer that may be used herein is made by National SemiConductor™ and is available from Digi-Key®, part no. LM555CN-ND.

Alternative versions of audio label 20 will be able to sense motion or the infrared or heat energy given off by the human body, or sense light changes to trigger the pre-recorded message as a person passes by the product having an audio label 20 attached thereto. Available sensor components of these types (light, temperature or infrared) include, for example, model nos. 276-1657, 276-137, RSU 11673290, RSU 11673308, RSU 11673324, and RSU 11673316 from Radio Shack$^{SM}$. Possible locations for such sensors are in the four corners of label 20 in lieu of spacers 38. See FIGS. 7 and 8, for example, in which triangular sensors 138 are substituted for each spacer 38. The triangular backside of sensor 138 is shown in dashed lines as are the electrical leads which are connected to substrate 24. The two exterior faces could/would provide multi-dimensional motion sensing. Note, other dispositions may also be provided (such as being built into the four corners of frame 21, for example) as will be understood in the art. Furthermore, simple switches may be used instead of the above triggering mechanisms (timers and/or sensors). For example, when properly labeled the inquisitive customer could simply press a button or flip a switch to hear the recorded message. And, most simplistically, a removable cover could be replaced to halt light collection by array 22 which would stop the entire device. Re-removal of the cover could then restart the production of sounds as desired. Thus, this would act as a simple "switch."

Referring now to FIGS. 11–19, still further alternative embodiments of an audio label system are shown. In the first of these versions, audio label 20 itself is generally of the same or similar structure as any of the above three embodiments or equivalents thereof although certain structural modifications hereto are available as will be described below. As shown in FIG. 11, this embodiment comprises an integrated system including a preferably photovoltaically-powered transmitter unit 50 which may be simply placed on a shelf 51 or, as shown, it may be mounted to a shelf 51 on, for example, a bracket 52. Shelf placement is preferred for simplicity; however, transmitter 50 could be mounted elsewhere as well. For example, it could be hung from an indoor ceiling (see FIG. 15) or strategically located on a wall or other display as will be described further below. Transmitter 50 is used with one or more photovoltaically-powered labels 20 which are directly applied to merchandise/products 250 via self-stick tape or adhesive 40 as described above. When transmitter 50 is to be photovoltaically powered, a large array of photovoltaic cells 53 is disposed on or near transmitter 50 and receives light as shown by the arrows in FIG. 11 to power voice storage/transmitter electronics disposed in transmitter unit 50. In the preferred embodiment, transmitter 50 also has a series of high output infrared light emitting diodes (LED's) 54 (see detail in FIG. 12) contained within a diffuser wand 56 attached to, and, in the preferred embodiment, depending from transmitter 50. Electronic audio output signals are sent to LED's 54 which then transform them into infrared light signals. The invisible infrared light signals emitted from LED's 54 to a plurality of products as shown by the arrows in FIG. 13 are then received by each individual label 20. In particular, as shown in FIG. 14, four infrared receivers/transducers such as phototransistors 58, which are disposed on each label 20 of this embodiment, gather the infrared light information from LED's 54. Available circuitry in each label 20 (see FIG. 19, for example, as discussed below) then transforms the light signals into electric signals which proceed to each speaker in each label 20 which turns the electric signals into audio sounds. This, thus causes each label 20 to "speak" or make the appropriate corresponding sounds. In this embodiment, each label 20 may still have a chip 25 and all the other previously described elements so that each label operates independently, for example, either continuously or by using sensors to sense a human presence. Or, each label 20 may be triggered into action by light signals sent from transmitter 50 without each label 20 necessarily having individual triggering mechanisms or even having a separate chip 25.

As described, transmitter wand 56 preferably hangs well below transmitter box 50 allowing the infrared information to be transmitted into all of the surrounding shelves. Also, wand 56 is preferably adjustably mounted to transmitter 50 so that it is flexible or moveable to provide optimum performance in emitting signals to label(s) 20. An example of such flexibility is a rotatable ball and socket connection such as have often been used for television or radio antennae. Wand 56 may also, depending on a particular application, stand upright or extend outwardly from transmitter 50 at any desired angle. Adjustable mountings may also be used with such embodiments. Moreover, wand 56 is made from plastic, glass or other suitable material.

Furthermore, phototransistors 58 may also have enhanced light receiving shapes such as the pyramid-shaped or the prismatic receivers described in FIG. 3 above so that they are able to "grab" the light signals travelling thereto from a plurality of directions. Note also that the light signals described here may be of any known sort such as visible, infrared, ultraviolet, white light, etc. However, other signal waves may also be used as practicable including, for example, other electromagnetic waves in the electromagnetic spectrum like radio waves or microwaves. An advantage of this control system embodiment is the ability to have a centralized sound transmitter so that a single message (or a plurality of distinct messages) can be re-recorded or changed in any way at one time for all or a select group of receiving labels 20. Thus, each label 20 need not necessarily have a chip 25 or equivalent sound storage or re-record means embodied therein. In practice, however, generally all of the above described embodiments have re-record capabilities whether on each label 20 or centrally at box 50 (or both), although this invention is not solely limited to requiring re-recordable labels.

Figure 19:
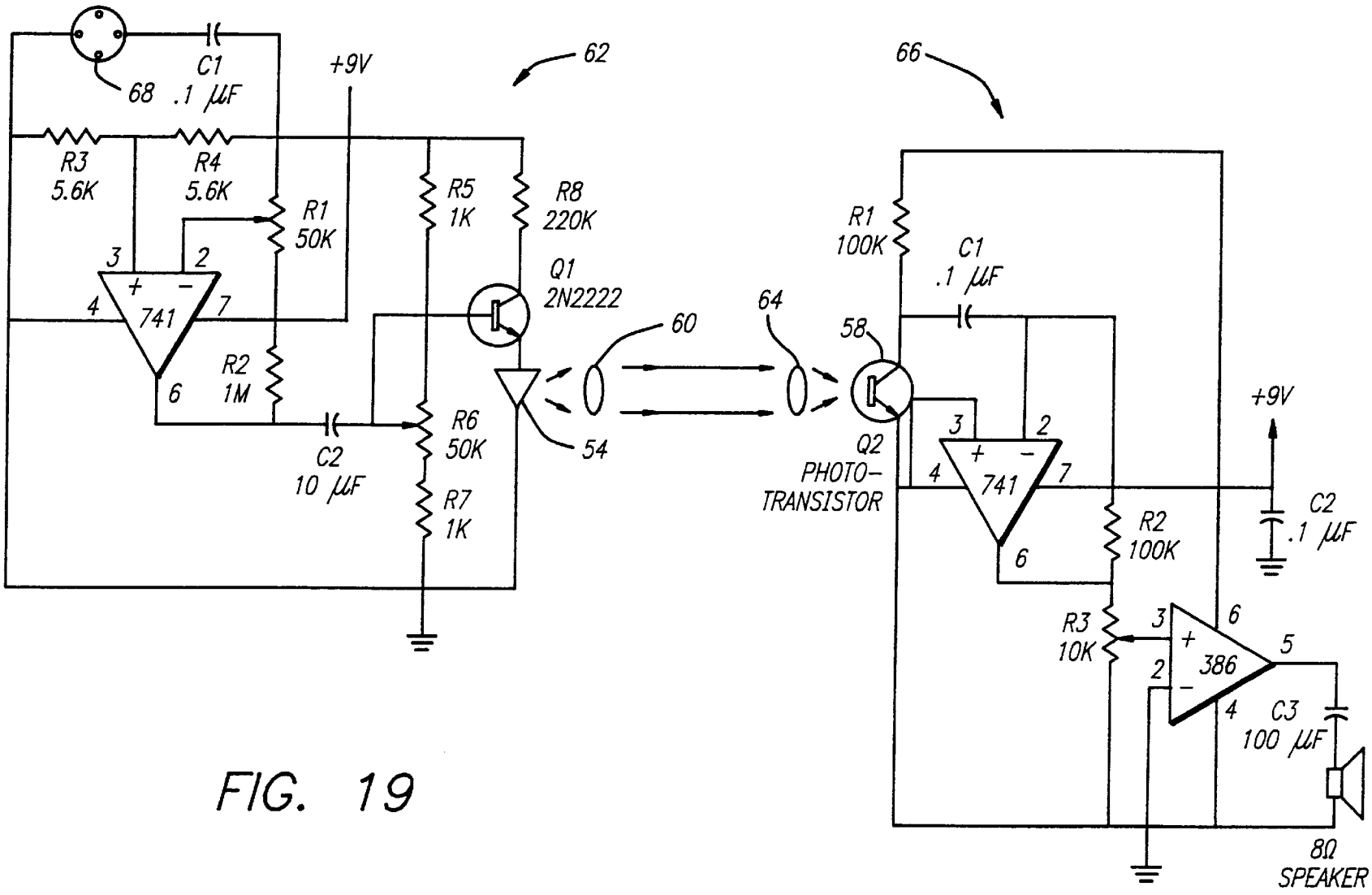
FIG. 19 is a circuit diagram for use with an alternative embodiment of the present invention.

Circuitry which may be used with this version of the present invention is shown in FIG. 19. This circuitry comprises two separate sets of electrical hardware which communicate via light waves emanating from an LED 54 through a lens 60 of transmitter hardware 62 to and through lens 64 to a phototransistor 58 in label 20 receiver hardware 66. Again, light waves are described here, but other electromagnetic waves (as described above) may be used instead.

In transmitter hardware 62 a crystal or electret microphone 68 receives and "picks up" sounds to be sent to label 20 receiver hardware 66. Microphone 68 is used here primarily for illustrative purposes. Other sound initiators (such as microcomputers, microchips 25 or other digital or analog sources) may be used in lieu thereof. In any event, sound signals proceed from microphone 68 (or its substitute) to the 741 amplifier which amplifies the signals and couples them through capacitor C2 to modulator transistor Q1. From there, appropriate signals are sent to at least one LED 54 which may be a high brightness red or a high-power infrared LED for best results. Lens 60 may be used in this embodiment to collimate the LED beam for a free-space range of up to 1,000 feet (at night). Optical fiber transmission may also be used. R1 of hardware 62 is a variable resistance resistor which is used for gain control. R6 is a similar device for LED bias control and R8 limits the current applied to LED 54.

Label 20 receiver hardware 66 also has a 741 amplifier as shown. R2 in hardware 66 is for gain control and R3 is for volume control. C2 prevents oscillation. Low light (or night-type light) provides the best results with this system for free-space communications. A shield (not shown) may be used if sunlight or bright artificial light is present. If infrared is used, an infrared filter should be used for best results. Developed color film works well as an infrared filter.

Nine (9) volt sources are shown for circuits here, and again, the preferred sources are the photovoltaic cells previously described. In any event, with nine volts supplied, this circuitry can produce loud sounds out of an 8 ohm speaker as shown here.

Alternative embodiments with respect to the system of FIGS. 11–14 abound. For example, as mentioned above, a transmitter 150 may be positioned to hang from the ceiling as shown in FIG. 15. This may be useful in that it may be centrally positioned relative to a single store aisle so that it may send signals directly to a plurality of labels 20 disposed on both sides of the aisle. Further, a high on the wall or ceiling mounted transmitter 150 could be positioned to provide signals to multiple store aisles serially or simultaneously. Alternatively, a master transmitter box 150 of this sort, mounted on the ceiling or high on a wall, could send signals to one or more shelf mounted transmitters 50 which, in turn, would then transmit to the individual labels 20. Thus, shelf-mounted transmitters 50 of this sort would also be receiving units, which first receive signals from the master transmitter box 150 and then transmit to the labels 20. These alternative devices then, may appropriately be referred to as receiver/transmitters 50. Receiver/transmitters 50 of this sort may also be ceiling or otherwise mounted.

Figure 17:
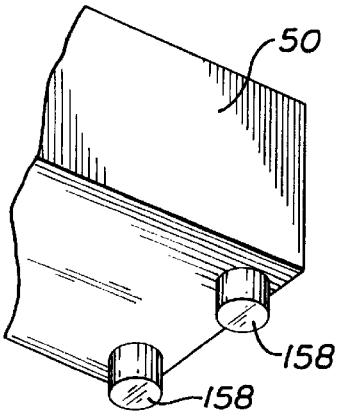
FIG. 17 is a fragmented enlarged view of the bottom side of alternative control system componentry.
Figure 16:
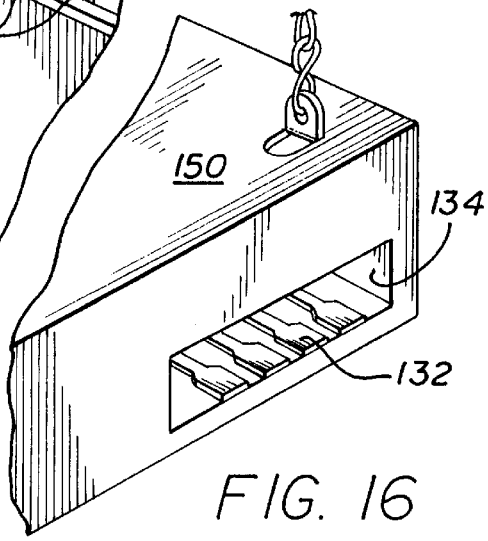
FIG. 16 is a fragmented enlarged view of the circled area "16" of FIG. 15.

In either case, the ultimate originator of the signal could be a microcomputer (PC, laptop, handheld, etc.) or other digital source as described above. Signals from such a source could be programmed into the electronics of a transmitter 150 (or a transmitter 50 of FIG. 11) via printed circuit board connectors 132 as shown in more detail in FIG. 16. A slot 134 defined in transmitter 150 (or transmitter 50) gives access to connectors 132 in a fashion similar to that described above for an embodiment of label 20. Moreover, the microcomputer (or other digital source) could also be modified (or connected to appropriate equipment) to transmit the signals to the ceiling and/or shelf and/or otherwise mounted receiver/transmitters 50 (or master transmitter 150 which would now also be a receiver as well) and/or directly to labels 20. Those skilled in the art will appreciate that such receiver/transmitters 50/150 will thus nee d t o have phototransistors 158 or like electromagnetic wave transducers mounted thereon to receive the appropriate signals. FIG. 17 shows two such phototransistors 158 mounted on the underside of an alternative embodiment of a receiver/transmitter 50/150. Moreover, it should be noted that these and all other embodiments of transmitter 50 may be made stationary or mobile depending on the needs of the user. Batteries, other DC sources or outlet AC power may also be used in addition to or in lieu of photovoltaic cells described above.

Figure 18:
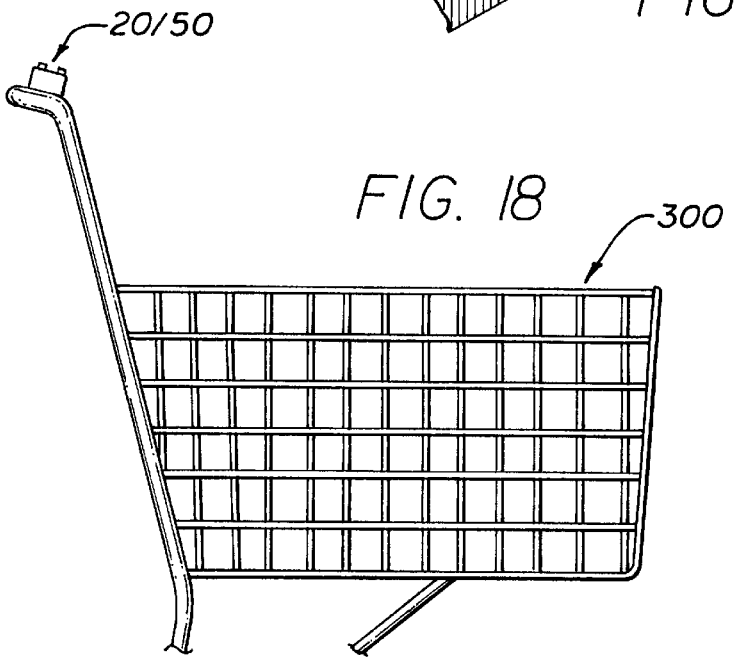
FIG. 18 is a fragmented elevation of an alternative embodiment of the present invention.

Still further, another version of this invention would use a transmitter 50/150 similar to either device shown in either FIG. 11 or FIG. 15. In this case, however, at least two options are available in which an operative unit is mounted to a consumer's shopping basket 300. As shown in FIG. 18, either a receiver/transmitter 50 or a label 20 is mounted to the basket 300. In the first option here, when a receiver/transmitter 50 is mounted on a basket 300, as a consumer strolls down a store aisle with a basket 300, audio advertisement signals would be sent by unit 50 to corresponding labels 20 disposed on or adjacent products on the store shelves. These signals would then be transformed by labels 20 into sounds which would come out of the labels 20 as described above. Alternatively, an appropriate alternative label 20 would be adapted to be mounted to the consumer's shopping cart and one or more receiver/transmitters 50 would be selectively placed at various locations within a store so that as soon as a shopper's cart 300 with a label 20 comes within an adequate distance of a receiver/transmitter 50, then label 20 would receive signals and change these to audio signals emanating directly from label 20 on basket 300. Thus, for example, the pre-recorded advertisements could be different on each aisle or several locations within an aisle, allowing the shopper to hear a variety of advertising messages. Also, again, the transmitter could be hung from the ceiling by thin wires instead of being mounted to the shelf. In this way then, it is possible for a transmitter to transmit a plurality of messages in a plurality of directions, thus cutting down the number of transmitters used. As above, all of these versions of the present invention may include sensors to detect the presence of people, triggering the appropriate audio label 20 into action only when someone approaches, thus saving electrical energy. Sensors 138 as described above, or etched in sensors may be used in these or any of the above-described embodiments.

Still further in any of the above embodiments of the present invention or their equivalents, the photovoltaic cell array 22 may, prior to actual use, be covered by an adhesively attached, removable sticker (not shown). In this way, then, no light would strike the photovoltaic cells until such is desired. As mentioned above, this could provide a consumer activatable switch for starting and stopping sound generation by label 20. Moreover, in some applications, it may be further useful to print a bar code like a Universal Product Code (UPC) label on the detachable sticker for the product for numerous possible purposes. For example, bulk shipments of pre-recorded labels 20 may have bar code labels stuck thereon for the dual purposes of blocking light from reaching the photovoltaic cell (so that label 20 is not activated to make sounds during shipment) and also so that they may be readily identified by a bar code reader in order that each label is appropriately applied to the proper corresponding packaging. The bar code thus identifies what sounds may be prerecorded on each label 20 for accurate placement on the appropriate product(s). Another bar code use particularly involving a UPC code can occur when a customer may, when he or she desires, remove the label as desired to hear the label sounds and then use the bar code for simple purchasing and store check out.

From the foregoing, it is readily apparent that new and useful embodiments of the present invention have been herein described and illustrated each of which fulfilling all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A stand-alone audio label for use in product presentation adapted for attachment to a product to be sold, said audio label comprising:

a circuit board substrate;

an adhesive layer attached to said substrate so that said audio label may be affixed to a product to be sold;

a photovoltaic cell attached to said circuit board substrate;

a sound-storing, sound-retrieving microchip attached to said circuit board substrate and connected to said photovoltaic cell so that said photovoltaic cell provides power to said microchip, said microchip being adapted to have audible sounds pre-recorded thereon in the form of signals which said microchip, upon activation, can communicate to replay said audible sounds; and a sound reproduction unit attached to said circuit board substrate and connected to said microchip so that when said microchip communicates signals to said sound reproduction unit, said signals are converted into audible sounds;

said sound reproduction unit having; a circular electromagnetic coil with a circular opening defined therein and top and bottom surfaces, a thin magnetic disk having a top surface and a bottom surface opposite to said top surface; said magnetic disk being movably disposed within the circular opening of said circular electromagnetic coil; said magnetic disk being held in moveable relationship therein by first and second flexible rubber membranes, said first membrane being connected to the respective top surfaces of said magnetic disk and said electromagnetic coil, and said second membrane being connected to the respective bottom surfaces of said magnetic disk; and said electromagnetic coil, said magnetic disk further having a protrusion with a rounded nose attached to the bottom surface thereof so that said rounded nose of said protrusion is disposed in moveable contact with said product; whereby upon the communication of the signals from the microchip to the sound reproduction unit, the electromagnetic coil is energized intermittently in response to said signals and upon the intermittent energization of said electromagnetic coil, said magnetic disk is moved intermittently in a vibratory fashion such that said protrusion vibrates said product to reproduce an audible sound.

2. A stand-alone audio label for use in product presentation adapted for attachment to a product to be sold, said audio label comprising:

a circuit board substrate;

an adhesive layer attached to said substrate so that said audio label may be affixed to a product to be sold;

a photovoltaic cell attached to said circuit board substrate;

a sound-storing, sound-retrieving microchip attached to said circuit board substrate and connected to said photovoltaic cell so that said photovoltaic cell provides power to said microchip, said microchip being adapted to have audible sounds pre-recorded thereon in the form of signals which said microchip, upon activation, can communicate to replay said audible sounds; and a sound reproduction unit attached to said circuit board substrate and connected to said microchip so that when said microchip communicates signals to said sound reproduction unit, said signals are converted into audible sounds and a timer connected, to said sound-generating microchip to actuate said sound-generating microchip at timed intervals.

3. A stand-alone audio label for use in product presentation adapted for attachment to a product to be sold, said audio label comprising:

a circuit board substrate;

an adhesive layer attached to said substrate so that said audio label may be affixed to a product to be sold;

a photovoltaic cell attached to said circuit board substrate;

a sound-storing, sound-retrieving microchip attached to said circuit board substrate and connected to said photovoltaic cell so that said photovoltaic cell provides power to said microchip, said microchip being adapted to have audible sounds pre-recorded thereon in the form of signals which said microchip, upon activation, can communicate to replay said audible sounds; and a sound reproduction unit attached to said circuit board substrate and connected to said microchip so that when said microchip communicates signals to said sound reproduction unit, said signals are converted into audible sounds, and a removable cover, detachably attachable to the photovoltaic cell to block light waves from reaching the photovoltaic cell when the removable cover is attached thereto and to permit light waves to access the photovoltaic cell when the removable cover is removed therefrom.

4. An audio label according to claim 3 in which said removable cover is a removable sticker.

5. An audio label according to claim 3 in which said removable cover has a bar code printed thereon.

6. An audio label according to claim 3 in which said bar code identifies the sounds pre-recorded on the audio label.

7. An audio label according to claim 5 in which said bar code identifies the product to which the label is to be affixed.

8. An audio label according to claim 5 in which said bar code is a Universal Product Code which provides for product identification during purchasing.

* * * * *